US005133312A

United States Patent [19]

Schede

[11] Patent Number: 5,133,312

[45] Date of Patent: Jul. 28, 1992

[54] FOOT-OPERATED STARTER ATTACHMENT FOR COMBUSTION ENGINES

[76] Inventor: Robert J. Schede, 248 Melville Dr., Fairfield, Conn. 06430

[21] Appl. No.: 745,747

[22] Filed: Aug. 16, 1991

[51] Int. Cl.[5] ..... F02N 3/02

[52] U.S. Cl. ..... 123/185.2; 56/10.5; 74/139

[58] Field of Search ..... 123/185.2, 185.3, 185.4; 56/10.5; 74/139, 140

[56] References Cited

U.S. PATENT DOCUMENTS

| | | | |
|---|---|---|---|
| 2,850,003 | 9/1958 | Konle | 123/185 |
| 3,040,726 | 6/1962 | Mayer | 123/185 |
| 3,174,471 | 3/1965 | Welglage et al. | 123/185 |
| 3,381,677 | 5/1968 | Hunter | 123/185 |
| 3,885,544 | 5/1975 | Pfeiffer | 123/179 |
| 4,109,538 | 8/1978 | Glenday et al. | 74/6 |
| 4,257,367 | 3/1981 | Fujikawa et al. | 123/185 BB |
| 4,397,274 | 8/1983 | Tarnedde | 123/185 BB |

*Primary Examiner*—Andrew M. Dolinar
*Attorney, Agent, or Firm*—H. Gibner Lehmann; K. Gibner Lehmann

[57] ABSTRACT

An engine starter attachment for use with equipment employing combustion engines having hand-operable starting cords. The attachment comprises a slide bar having a slider equipped with a stirrup to enable foot power to be applied to the slider. A cable attached to the slider passes over a swivel pulley and is connected to the engine pull cord so that foot power can be used in starting the engine.

14 Claims, 1 Drawing Sheet

Fig: 1
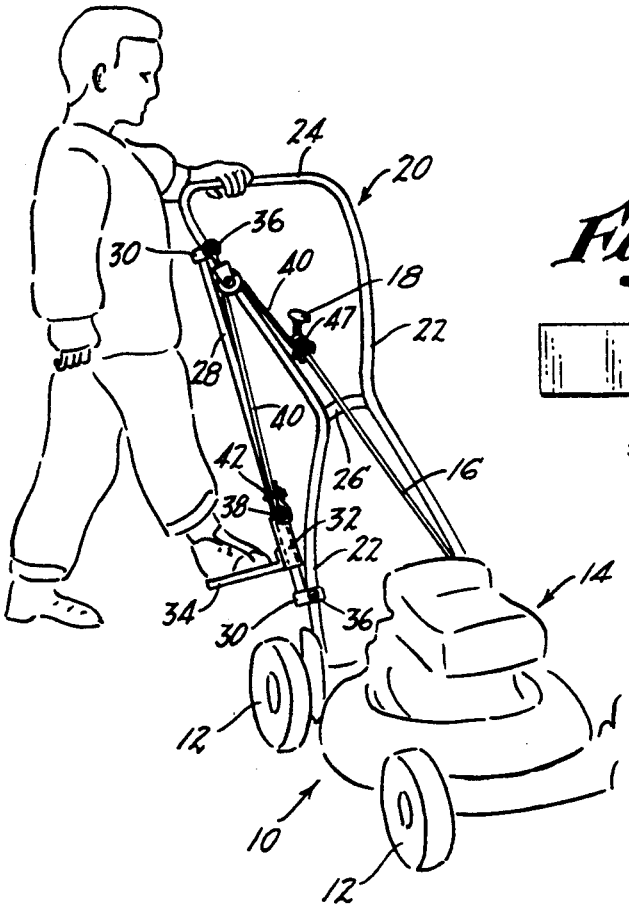
Fig: 3
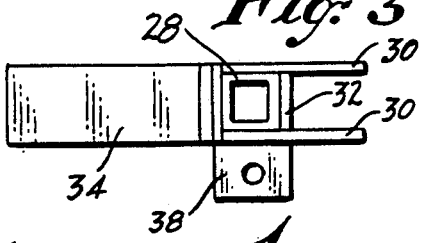
Fig: 4
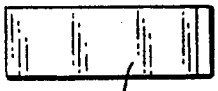
Fig: 2
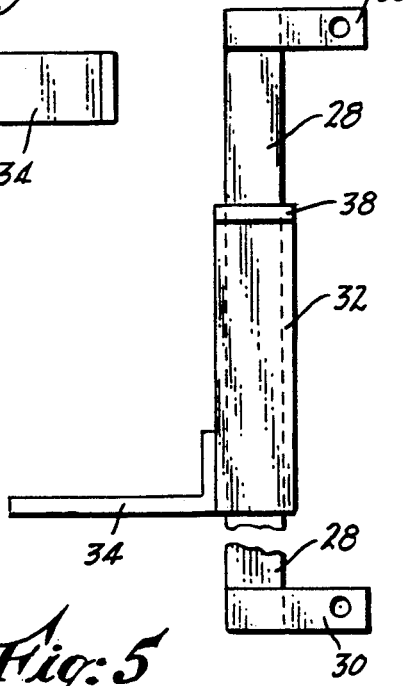
Fig: 5
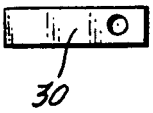
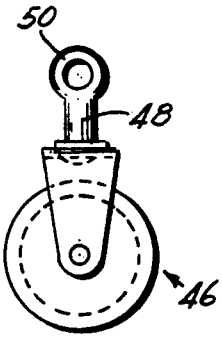
Fig: 6
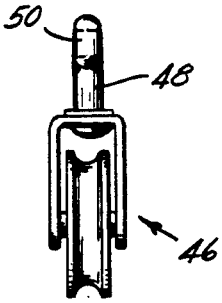
Fig: 7
Fig: 8
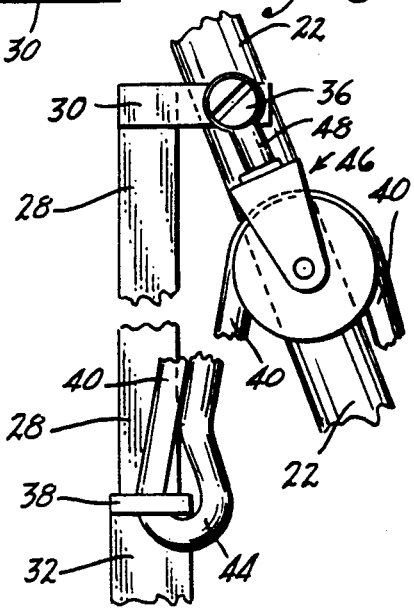

FOOT-OPERATED STARTER ATTACHMENT FOR COMBUSTION ENGINES

STATEMENT AS TO RIGHTS TO INVENTIONS MADE UNDER FEDERALLY-SPONSORED RESEARCH AND DEVELOPMENT.

Research and development of the present invention and application have not been Federally-sponsored, and no rights are given under any Federal program.

BACKGROUND OF THE INVENTION

1. Field of the Invention

This invention relates to combustion engine starters, and more particularly to foot-operated attachments for use with already existing manual starter devices.

2. Description of the related art including information disclosed under 37 CFR §§ 1.97-1.99

In the past, various types of foot-operated starters have been proposed and produced, for facilitating the starting of combustion engines as employed in lawn mowers and the like. The prior devices, while admittedly operative, in most cases had drawbacks and disadvantages which worked against their widespread use.

For example, U.S. Pat. No. 2,850,003 shows a pivotally-mounted foot starter for a lawn mower having a pedal 24 arranged to actuate a lever 22 which latter is attached at handle 20 to the starter cord, see FIG. 1. FIGS. 6 and 7 show a treadle bar 111 on a lever 100, 102. This device is not mechanically sound because of the possible frailties in the pivot and the long, unsupported arm of the lever 22.

In U.S. Patent No. 3,040,726 a slide 33 has a foot pad 32 and connects to the top of a vertical spiral shaft 26 to cause rotation of the latter when the pad 32 is depressed. A clutch 24 at the bottom of the shaft engages a cooperable part 23 to turn over the engine shaft. The part 35 is merely a rubber grip handle. The operating handle of the mower is not shown or involved, presumably. If the engine should "kick back" the results on the working parts could be undesirable.

A different scheme is shown in U.S. Pat. No. 3,174,471, where the handle 42 of the mower itself operates a rack 26 having teeth which mesh with a gear 13 on the shaft of the engine. This is a complicated and costly arrangement, and is not easily installed as an attachment to existing mowers. The rack, pinion and clutch must be heavy duty, to withstand any "kick-back", and will require lubrication. These are all drawbacks.

A lever-type foot-operated starter is also disclosed in U.S. Pat. No. 3,381,677, where a lever 32 is provided with a foot pedal 38, and uses a pull member 40 that passes around a pulley 44, see FIGS. 2 and 3. The absence of a sturdy foot-operated slide, however, with a good long working stroke is a disadvantage in the operation of the device.

A different approach is shown in U.S. Pat. No. 3,885,544 where an electric drill has its chuck coupled to start a combustion engine, through a suitable clutch device 22, see FIG. 2. This idea is not all that practical, due to the diversity of the powers involved, and the possibility of injury from engine kick-back.

A prior device which can be readily attached to a lawn mower is that of Glenday, U.S. Pat. No. 4,109,538. This patent shows a non-slider type of foot operator attachable to the mower handle, having a stirrup or handle 33. The device has an articulated vertical strut

36 with a pivot joint 37 by which it can be folded to foreshorten it somewhat after the engine has been started. Even so, the strut hangs pendant from the handle, and thus can be a source of interference during use of the mower. However, this construction has disadvantages due to the lack of a sturdy slide and sturdy mounting to the handle frame of the mower, and also due to the terrain and space requirements and the lack of stability.

U.S. Pat. No. 4,257,367 shows various arrangements where a foot pedal 14 is pivotally mounted to operate the pull cord of an engine for starting purposes. The use of the pivots and shafts, complicated pulley arrangements and the like are clearly drawbacks. The mechanical ratio of load to driving force makes for a dangerous situation in the event of engine kick-back, since the back force on the pedal is magnified.

U.S. Pat. No. 4,397,274 shows a number of various kinds of foot-operated starters for a mower. These are mostly characterized by pivoting assemblages, not slides, and such starters do not have the advantage of a sturdy slide that can withstand heavy foot pressures, nor the stroke advantage of a direct connection between the pull cord and the pedal.

SUMMARY OF THE INVENTION

The above disadvantages and drawbacks of prior foot-operated combustion-engine starters are obviated by the present invention, which has for one object the provision as a new article of manufacture of a novel and improved foot-operated slider-type starter attachment for combustion engine powered equipment, which is especially sturdy and reliable, and safe to use.

Another object of the invention is to provide an improved starter attachment as above characterized, which is particularly simple in construction and low in cost.

A further object of the invention is to provide an improved engine starter attachment in accordance with the foregoing, which can be quickly and easily installed on a large variety of powered mowers.

Yet another object of the invention is to provide an improved starter attachment as outlined above, which can be fabricated from readily available materials, and by using existing methods of fabrication.

A feature of the invention is the provision of an improved engine starter attachment of the kind indicated, which requires relatively little space, and which can remain permanently attached to the mower.

Another feature of the invention is the provision of an improved starter attachment, which does not require lubrication or special care or maintenance.

In accomplishing the above objects the invention provides a sturdy slider means including an elongate slide bar, with means for attaching the slide bar to the equipment that has the engine, a swivel pulley and a pull cable passing around the pulley for attachment to the engine pull cord. The pulley mounts at the top of the slide bar, and the latter has a stirrup-equipped slider keyed to it, to which the pull cable is fastened. By depressing the slider with his foot on the stirrup, the user converts the downward motion into an opposite upward motion and thereby easily causes a powerful pull on the engine pull cord, to start the engine.

The components can be fabricated of structural steel, welded together whereby an extremely sturdy working assemblage is had, one which can withstand powerful forces.

Other features and advantages will hereinafter appear.

BRIEF DESCRIPTION OF THE DRAWINGS

In the accompanying drawings:

FIG. 1 is a diagrammatic perspective view of a power lawn mower incorporating the present improved starting attachment, being operated by a user.

FIG. 2 is a fragmented side elevational view of slide portions of the starting attachment.

FIG. 3 is a top plan view of the slide portions shown in FIG. 2.

FIG. 4 is a top plan view of a stirrup component of the slide portions shown in FIG. 2.

FIG. 5 is a side elevational view of a bracket part of the slide portions of FIG. 2.

FIG. 6 is a side elevational view of the swivel pulley part of the starter attachment.

FIG. 7 is a frontal elevational view of the swivel pulley of FIG. 6, and

FIG. 8 is a fragmented frontal elevational view of the pulley and operational pull cable portions of the starter attachment.

DESCRIPTION OF THE PREFERRED EMBODIMENT

Referring first to FIG. 1 there is illustrated a conventional type of rotary lawn mower 10 equipped with wheels 12 and a combustion type power unit or engine 14 having the usual starter pull cord 16 with knob or handle 18. The mower 10 has a handle frame 20 comprising side rails 22, top hand rail 24 and cross brace 26.

In accordance with the present invention, in conjunction with the handle frame 20 and starter pull cord 16 there is provided a novel and improved engine starter attachment which enables foot-power actuating of the pull cord 16 to be conveniently and reliably effected. By virtue of this, starting of the engine 14 no longer requires the operator to bend down or over in order to turn over the crankshaft or crank the engine. Additionally, the use of the arms or arm muscles is no longer a requirement and is supplanted by the legs and leg muscles. Also there is eliminated the likelihood of injury when cranking, due to balky starting or kicking of the engine. With the additional power provided by the legs, quicker and surer engine starts are possible all with less likelihood of fatigue.

As seen in FIGS. 1 and 2, the present starter attachment is characterized by a strong slider assemblage having an appreciable stroke or travel. This slider assemblage comprises an elongate slide bar 28 provided at its ends with pairs of spaced-apart apertured attachment arms or brackets 30, and a slider sleeve 32 thereon which can travel the length of the slide bar.

The slider assemblage further comprises a stirrup member 34 which is attached to one end of the sleeve 32 and which projects laterally therefrom in a position to accommodate the foot of the user, as clearly shown in FIG. 1. The spacing between the arms 30 of the pairs is such as to accommodate the one side rail 22, and said rail is drilled to enable bolts 36 to pass through it and through the apertures of the arms 30 whereby the slide bar 28 can be firmly and rigidly affixed to the handle frame 20 in the manner shown in FIG. 1, with the stirrup extending outward and laterally, essentially in the same plane as the handle frame. The slide bar 28 is also seen to be in the same plane as the handle frame 20.

As shown in FIGS. 2, 3 and 8 and in accordance with the present invention the slide bar 28 and slider sleeve 32 are of square cross section, the bar 28 being tubular or hollow. By this construction there is an inherent means which keys the slider sleeve 32 against turning with respect to the bar 28 at all times. This, of course, is especially important during the traversal or movement of the sleeve along the bar. Moreover, such construction, apart from being especially simple and less costly, has a minimum likelihood of jamming and instead presents a minimum resistance to movement during operation of the starter.

The invention provides, in conjunction with the above slider assemblage, an especially simple and practical means to transfer foot power that is applied to the stirrup 34 to the pull cord 16 of the engine. Accordingly as viewed in FIGS. 2 and 3, the sleeve 32 at its upper end has an anchorage fitting or plate 38 projecting laterally from the sleeve, in a direction at right angles to the stirrup 34. The plate 38 has an aperture, through which a pull cable 40 is passed. The end portion of the cable 40 is folded back on itself and secured or anchored by a cable fitting 42, see FIG. 1, to form a closed loop indicated at 44.

Also, at the upper end of the slide bar 28 there is provided a swivel pulley 46 around which the free end of the cable 40 is passed, after which such end is secured to the end of the engine pull cord 16 at the knob or handle 18 by use of a suitable cable clamp 47, FIG. 1.

As seen in FIGS. 6–8, the swivel pulley 46 has a tether stud 48 terminating in an eye 50. The upper attachment bolt 36 passes through the eye 50 of the tether stud 48 and thus secures the swivel pulley 46 in place, as well as attaching the upper end of the slide bar 28 to the mower handle frame 20.

With the attachment thus assembled, the end of the starting stroke is shown in FIG. 1. Prior to this, the slider sleeve 32 will occupy a raised position on the slide bar, such position being essentially as depicted in FIG. 2.

The invention provides for assemblage of the attachment arms 30 to the slide bar by welding, and attachment of the stirrup 34 and anchorage fitting or plate 38 to this slider sleeve 32 by welding. As thus constructed, the starter attachment of the invention is now seen to be especially sturdy and fool-proof. cost. The installation of the attachment can be easily and quickly effected on a large assortment and variety of makes and models of mowers. Adjustment after installation involves the simple procedure of resetting the connection between the pull cable 40 of the attachment and the pull cord 16 of the engine, by loosening the cable clamp 47. The attachment does not require lubrication or special handling because of its occasional use, and is safe to use by virtue of its simple and strong construction. It is also unlikely to cause injury to the user from engine kickback, especially since the entire body weight can be used in a natural manner to back up the foot that is on the pedal.

Variations and modifications are possible without departing from the spirit of the invention.

Each and every one of the appended claims defines an aspect of the invention which is separate and distinct from all others, and accordingly it is intended that each claim be treated in this manner when examined in the light of the prior art devices in any determination of novelty or validity.

What is claimed is:

1. As a new article of manufacture, a foot-operated engine starter assemblage for attachment to equipment having an internal combustion engine of the type equipped with a starter pull cord, comprising in combination:

a) slider means including an elongate slide bar and a slider member held captive on and movable along said slide bar, b) means for attaching the slide bar to said equipment, c) a swivel pulley, d) means for mounting the swivel pulley at the upper part of the slide bar, e) a pull cable adapted to pass over said swivel pulley, f) means for attaching one end of the pull cable to said slider member, g) a stirrup carried by said slider member, enabling one foot of a user to drive the member along the slide bar, and h) means for attaching the other end of the pull cable to the free end of the pull cord of the internal combustion engine.

2. An engine starter assemblage as set forth in claim 1, wherein the equipment comprises a lawn mower having a handle frame disposed essentially in a plane, and wherein the slide bar is disposed in the same plane as the handle frame.

3. An engine starter assemblage as set forth in claim 1, wherein the slider member comprises a sleeve which encircles the slide bar.

4. An engine starter assemblage as set forth in claim 1, wherein the means for attaching the slide bar to the equipment are disposed at the ends of the slide bar.

5. An engine starter assemblage as set forth in claim 3, wherein:

a) the slider member is elongate and has a stirrup at one of its ends and an anchor for said pull cable at the other of its ends.

6. An engine starter assemblage as set forth in claim 2, wherein the swivel pulley is attached adjacent one end of the slide bar.

7. An engine starter assemblage as set forth in claim 4, wherein the swivel pulley is attached to one of said attachment means for the slide bar.

8. An engine starter assemblage as set forth in claim 4, wherein the equipment comprises a lawn mower having a handle frame, and wherein the means for attaching the slide bar comprises bolts adapted to be secured to the handle frame of the lawn mower.

9. An engine starter assemblage as set forth in claim 1, wherein the slide bar has a square section, and wherein the slider member comprises a square-section sleeve telescoping with the slide bar.

10. An engine starter assemblage as set forth in claim 9, wherein the attachment means for the slide bar comprises pairs of arms which are welded to opposite surfaces of the slide bar.

11. An engine starter assemblage as set forth in claim 1, wherein the slider member is of square section, said stirrup being welded to one side of the slider member and said cable-attaching means comprising a fitting welded to another side of the slider member.

12. As a new article of manufacture, a foot-operated engine starter assemblage for attachment to equipment having an internal combustion engine of the type equipped with a starter pull cord, comprising in combination:

a) slider means including an elongate slide bar having spaced-apart end portions and including a slider member held captive on and movable along said slide bar, b) means attached to the spaced-apart end portions of the slide bar for attaching the slide bar to spaced-apart locations on said equipment for support solely thereon, c) a pulley, d) means for mounting the pulley at the upper part of the slide bar, e) means for connecting one end of the starter pull cord of the engine to said slider member, and f) a stirrup carried by said slider member, enabling one foot of a user to drive the member along the slide bar.

13. An engine starter assemblage as set forth in claim 12, wherein the means for connecting the starter pull cord of the engine to the slider member comprises a pull cable.

14. As a new article of manufacture, a foot-operated engine starter assemblage for attachment to equipment having an internal combustion engine of the type equipped with a starter pull cord, comprising in combination:

a) slider means including an elongate slide and a slider member held captive on and movable along said slide bar, b) means for attaching the slide bar to said equipment, c) a pulley, d) means for mounting the pulley at the upper part of the slide bar, e) means for connecting one end of the starter pull cord of the engine to said slider member, and f) a stirrup carried by said slider member, enabling one foot of a user to drive the member along the slide bar, g) said pulley being a swivel pulley.

* * * * *